US008694310B2

(12) United States Patent
Taylor

(10) Patent No.: US 8,694,310 B2
(45) Date of Patent: Apr. 8, 2014

(54) REMOTE CONTROL SERVER PROTOCOL SYSTEM

(75) Inventor: Norrie Taylor, Vancouver (CA)

(73) Assignee: QNX Software Systems Limited, Ontario (CA)

( * ) Notice: Subject to any disclaimer, the term of this patent is extended or adjusted under 35 U.S.C. 154(b) by 1445 days.

(21) Appl. No.: 12/056,618

(22) Filed: Mar. 27, 2008

(65) Prior Publication Data

US 2009/0076824 A1 Mar. 19, 2009

Related U.S. Application Data

(60) Provisional application No. 60/973,131, filed on Sep. 17, 2007.

(51) Int. Cl.
*G10L 21/00* (2013.01)

(52) U.S. Cl.
USPC ..... 704/226

(58) Field of Classification Search
CPC ..... G10L 21/02; G10L 15/00; G10L 2015/00; G10L 21/0208
USPC ..... 704/226
See application file for complete search history.

(56) References Cited

U.S. PATENT DOCUMENTS

| | | | |
|---|---|---|---|
| 4,238,746 | A | 12/1980 | McCool et al. |
| 4,282,405 | A | 8/1981 | Taguchi |
| 4,486,900 | A | 12/1984 | Cox et al. |
| 4,531,228 | A | 7/1985 | Noso et al. |
| 4,628,156 | A | 12/1986 | Irvin |
| 4,630,305 | A | 12/1986 | Borth et al. |
| 4,731,846 | A | 3/1988 | Secrest et al. |
| 4,791,390 | A | 12/1988 | Harris et al. |
| 4,811,404 | A | 3/1989 | Vilmur et al. |
| 4,843,562 | A | 6/1989 | Kenyon et al. |
| 4,939,685 | A | 7/1990 | Feintuch |
| 4,969,192 | A | 11/1990 | Chen et al. |
| 5,027,410 | A | 6/1991 | Williamson et al. |
| 5,056,150 | A | 10/1991 | Yu et al. |
| 5,146,539 | A | 9/1992 | Doddington et al. |
| 5,278,780 | A | 1/1994 | Eguchi et al. |
| 5,313,555 | A | 5/1994 | Kamiya |

(Continued)

FOREIGN PATENT DOCUMENTS

| | | |
|---|---|---|
| CA | 2158847 | 9/1994 |
| CA | 2157496 | 10/1994 |

(Continued)

OTHER PUBLICATIONS

Anderson C.M., et al: "Adaptive Enhancement of Finite Bandwidth Signals in White Gaussian Noise," *IEEE Trans. On Acoustics, Speech and Signal Processing*, vol. ASSP-31, No. 1, Feb. 1983, pp. 17-28.

(Continued)

*Primary Examiner* — Jakieda Jackson
(74) *Attorney, Agent, or Firm* — Brinks Gilson & Lione

(57) ABSTRACT

A remote control server protocol system transports data to a client system. The client system communicates with the server application using a platform-independent communications protocol. The client system sends commands and audio data to the server application. The server application may respond by transmitting audio and other messages to the client system. The messages may be transmitted over a single communications channel.

23 Claims, 19 Drawing Sheets

(56) References Cited

U.S. PATENT DOCUMENTS

| | | | | |
|---|---|---|---|---|
| 5,377,276 | A | 12/1994 | Terai et al. | |
| 5,400,409 | A | 3/1995 | Linhard | |
| 5,406,622 | A | 4/1995 | Silverberg et al. | |
| 5,412,735 | A | 5/1995 | Engebretson et al. | |
| 5,432,859 | A | 7/1995 | Yang et al. | |
| 5,473,702 | A | 12/1995 | Yoshida et al. | |
| 5,479,517 | A | 12/1995 | Linhard | |
| 5,494,886 | A | 2/1996 | Kehne et al. | |
| 5,495,415 | A | 2/1996 | Ribbens et al. | |
| 5,502,688 | A | 3/1996 | Recchione et al. | |
| 5,526,466 | A | 6/1996 | Takizawa | |
| 5,568,559 | A | 10/1996 | Makino | |
| 5,572,262 | A | 11/1996 | Ghosh | |
| 5,584,295 | A | 12/1996 | Muller et al. | |
| 5,590,241 | A | 12/1996 | Park et al. | |
| 5,615,298 | A | 3/1997 | Chen | |
| 5,617,508 | A | 4/1997 | Reaves | |
| 5,641,931 | A | 6/1997 | Ogai et al. | |
| 5,677,987 | A | 10/1997 | Seki et al. | |
| 5,680,508 | A | 10/1997 | Liu | |
| 5,692,104 | A | 11/1997 | Chow et al. | |
| 5,701,344 | A | 12/1997 | Wakui | |
| 5,714,997 | A | 2/1998 | Anderson | |
| 5,742,694 | A | 4/1998 | Eatwell | |
| 5,819,215 | A | 10/1998 | Dobson et al. | |
| 5,845,243 | A | 12/1998 | Smart et al. | |
| 5,920,840 | A | 7/1999 | Satyamurti et al. | |
| 5,920,848 | A | 7/1999 | Schutzer et al. | |
| 5,933,801 | A | 8/1999 | Fink et al. | |
| 5,949,886 | A | 9/1999 | Nevins et al. | |
| 5,949,888 | A | 9/1999 | Gupta et al. | |
| 5,953,694 | A | 9/1999 | Pillekamp | |
| 6,011,853 | A | 1/2000 | Koski et al. | |
| 6,084,907 | A | 7/2000 | Nagano et al. | |
| 6,111,957 | A | 8/2000 | Thomasson | |
| 6,144,336 | A | 11/2000 | Preston et al. | |
| 6,163,608 | A | 12/2000 | Romesburg et al. | |
| 6,167,375 | A | 12/2000 | Miseki et al. | |
| 6,173,074 | B1 | 1/2001 | Russo | |
| 6,175,602 | B1 | 1/2001 | Gustafsson et al. | |
| 6,192,134 | B1 | 2/2001 | White et al. | |
| 6,199,035 | B1 | 3/2001 | Lakaniemi et al. | |
| 6,219,418 | B1 | 4/2001 | Eriksson et al. | |
| 6,249,275 | B1 | 6/2001 | Kodama | |
| 6,282,430 | B1 | 8/2001 | Young | |
| 6,405,168 | B1 | 6/2002 | Bayya et al. | |
| 6,408,273 | B1 | 6/2002 | Quagliaro et al. | |
| 6,434,246 | B1 | 8/2002 | Kates et al. | |
| 6,473,409 | B1 | 10/2002 | Malvar | |
| 6,493,338 | B1 | 12/2002 | Preston et al. | |
| 6,507,814 | B1 | 1/2003 | Gao | |
| 6,587,816 | B1 | 7/2003 | Chazan et al. | |
| 6,628,781 | B1 | 9/2003 | Grundström et al. | |
| 6,633,894 | B1 | 10/2003 | Cole | |
| 6,643,619 | B1 | 11/2003 | Linhard et al. | |
| 6,687,669 | B1 | 2/2004 | Schrögmeier et al. | |
| 6,690,681 | B1 | 2/2004 | Preston et al. | |
| 6,725,190 | B1 | 4/2004 | Chazan et al. | |
| 6,771,629 | B1 | 8/2004 | Preston et al. | |
| 6,782,363 | B2 | 8/2004 | Lee et al. | |
| 6,804,640 | B1 | 10/2004 | Weintraub et al. | |
| 6,822,507 | B2 | 11/2004 | Buchele | |
| 6,836,761 | B1 | 12/2004 | Kawashima et al. | |
| 6,859,420 | B1 | 2/2005 | Coney et al. | |
| 6,871,176 | B2 | 3/2005 | Choi et al. | |
| 6,891,809 | B1 | 5/2005 | Ciccone et al. | |
| 6,898,293 | B2 | 5/2005 | Kaulberg | |
| 6,910,011 | B1 | 6/2005 | Zakarauskas | |
| 6,937,978 | B2 | 8/2005 | Liu | |
| 7,020,291 | B2 | 3/2006 | Buck et al. | |
| 7,026,957 | B2 * | 4/2006 | Rubenstein | 340/988 |
| 7,117,149 | B1 | 10/2006 | Zakarauskas | |
| 7,146,012 | B1 | 12/2006 | Belt et al. | |
| 7,146,316 | B2 | 12/2006 | Alves | |
| 7,167,516 | B1 | 1/2007 | He | |
| 7,167,568 | B2 | 1/2007 | Malvar et al. | |
| 7,206,418 | B2 | 4/2007 | Yang et al. | |
| 7,231,347 | B2 | 6/2007 | Zakarauskas | |
| 7,269,188 | B2 | 9/2007 | Smith | |
| 7,272,566 | B2 | 9/2007 | Vinton | |
| 7,302,390 | B2 * | 11/2007 | Yang et al. | 704/246 |
| 7,613,532 | B2 * | 11/2009 | Anderson et al. | 700/94 |
| 7,653,543 | B1 * | 1/2010 | Blair et al. | 704/270 |
| 8,005,668 | B2 * | 8/2011 | Arun | 704/226 |
| 2001/0005822 | A1 | 6/2001 | Fujii et al. | |
| 2001/0028713 | A1 | 10/2001 | Walker | |
| 2002/0052736 | A1 | 5/2002 | Kim et al. | |
| 2002/0071573 | A1 | 6/2002 | Finn | |
| 2002/0176589 | A1 | 11/2002 | Buck et al. | |
| 2003/0040908 | A1 | 2/2003 | Yang et al. | |
| 2003/0093265 | A1 | 5/2003 | Xu et al. | |
| 2003/0093270 | A1 | 5/2003 | Domer | |
| 2003/0097257 | A1 | 5/2003 | Amada et al. | |
| 2003/0101048 | A1 | 5/2003 | Liu | |
| 2003/0206640 | A1 | 11/2003 | Malvar et al. | |
| 2003/0216907 | A1 | 11/2003 | Thomas | |
| 2004/0002856 | A1 | 1/2004 | Bhaskar et al. | |
| 2004/0002858 | A1 * | 1/2004 | Attias et al. | 704/226 |
| 2004/0024600 | A1 | 2/2004 | Hamza et al. | |
| 2004/0071284 | A1 | 4/2004 | Abutalebi et al. | |
| 2004/0078200 | A1 | 4/2004 | Alves | |
| 2004/0138882 | A1 | 7/2004 | Miyazawa | |
| 2004/0165736 | A1 | 8/2004 | Hetherington et al. | |
| 2004/0167777 | A1 | 8/2004 | Hetherington et al. | |
| 2004/0179610 | A1 | 9/2004 | Lu et al. | |
| 2005/0075866 | A1 | 4/2005 | Widrow | |
| 2005/0114128 | A1 | 5/2005 | Hetherington et al. | |
| 2005/0240401 | A1 | 10/2005 | Ebenezer | |
| 2006/0034447 | A1 | 2/2006 | Alves et al. | |
| 2006/0056502 | A1 | 3/2006 | Callicotte | |
| 2006/0074646 | A1 | 4/2006 | Alves et al. | |
| 2006/0089958 | A1 | 4/2006 | Giesbrecht et al. | |
| 2006/0089959 | A1 | 4/2006 | Nongpiur et al. | |
| 2006/0100868 | A1 | 5/2006 | Hetherington et al. | |
| 2006/0115095 | A1 | 6/2006 | Giesbrecht et al. | |
| 2006/0116873 | A1 | 6/2006 | Hetherington et al. | |
| 2006/0251268 | A1 | 11/2006 | Hetherington et al. | |
| 2006/0287859 | A1 | 12/2006 | Hetherington et al. | |
| 2007/0033031 | A1 | 2/2007 | Zakarauskas | |
| 2007/0088544 | A1 * | 4/2007 | Acero et al. | 704/226 |
| 2007/0136055 | A1 | 6/2007 | Hetherington | |
| 2008/0010057 | A1 * | 1/2008 | Chengalvarayan et al. | 704/9 |
| 2008/0300025 | A1 * | 12/2008 | Song et al. | 455/569.1 |
| 2009/0119088 | A1 * | 5/2009 | Ferris | 703/23 |
| 2009/0146848 | A1 * | 6/2009 | Ghassabian | 341/22 |
| 2011/0131045 | A1 * | 6/2011 | Cristo et al. | 704/249 |

FOREIGN PATENT DOCUMENTS

| | | | |
|---|---|---|---|
| CA | 2158064 | | 10/1994 |
| EP | 0 076 687 | A1 | 4/1983 |
| EP | 0 275 416 | | 7/1988 |
| EP | 0 558 312 | A1 | 9/1993 |
| EP | 0 629 996 | A2 | 12/1994 |
| EP | 0 629 996 | A3 | 12/1994 |
| EP | 0 750 291 | A1 | 12/1996 |
| EP | 0 948 237 | A2 | 10/1999 |
| EP | 1 450 353 | A1 | 8/2004 |
| EP | 1 450 354 | A1 | 8/2004 |
| EP | 1 669 983 | A1 | 6/2006 |
| JP | 06269084 | A2 | 9/1994 |
| JP | 06319193 | A | 11/1994 |
| WO | WO 0041169 | A1 | 7/2000 |
| WO | WO 0156255 | A1 | 8/2001 |
| WO | WO 0173761 | A1 | 10/2001 |
| WO | WO 2006/130668 | | 12/2006 |

OTHER PUBLICATIONS

Avendano, C. et al., "Study on the Dereverberation of Speech Based on Temporal Envelope Filtering," Proc. ICSLP '96, Oct. 1996, pp. 889-892.

Berk et al., "Data Analysis with Microsoft Excel," Duxbury Press, 1998, pp. 236-239 and 256-259.

(56) References Cited

OTHER PUBLICATIONS

Bilcu, R.C. et al., "A New Variable Length LMS Algorithm: Theoretical Analysis and Implementations," 2002, IEEE, pp. 1031-1034.
Byun K.J., et al: "Noise Whitening-Based Pitch Detection for Speech Highly Corrupted by Colored Noise," *ETRI Journal*, vol. 25, No. 1, Feb. 2003, pp. 49-51.
Campbell D.A., et al: "Dynamic Weight Leakage for LMS Adaptive Linear Predictors," *Tencon '96 Proceedings*, 1996 IEEE Tencon Digital Signal Processing Applications Perth, WA, Australia Nov. 26-29, 1996, NY, NY, USA, IEEE, US, vol. 2, Nov. 26, 1996, pp. 574-579.
Chang J.H., et al: "Pitch Estimation of Speech Signal Based on Adaptive Lattice Notch Filter," *Signal Processing*, Elsevier Science Publishers B.V. Amsterdam, NL, vol. 85, No. 3, Mar. 2005, pp. 637-641.
Fiori, S. et al., "Blind Deconvolution by Modified Bussgang Algorithm," Dept. of Electronics and Automatics—University of Ancona (Italy), ISCAS 1999, 4 pages.
Kang, Hae-Dong; "Voice Enhancement Using a Single Input Adaptive Noise Elimination Technique Having a Recursive Time-Delay Estimator," Kyungbook National University (Korea), Doctoral Thesis, Dec. 31, 1993, pp. 11-26.
Kauppinen, I., "Methods for Detecting Impulsive Noise in Speech and Audio Signals," 2002, IEEE, pp. 967-970.
Koike, S., "Adaptive Threshold Nonlinear Algorithm for Adaptive Filters with Robustness Against Impulse Noise," 1996, IEEE, NEC Corporation, Tokyo 108-01, pp. 1644-1647.
Learned, R.E. et al., A Wavelet Packet Approach to Transient Signal Classification, Applied and Computational Harmonic Analysis, 1995, pp. 265-278.
Nakatani, T., Miyoshi, M., and Kinoshita, K., "Implementation and Effects of Single Channel Dereverberation Based on the Harmonic Structure of Speech," Proc. of IWAENC—2003, Sep. 2003, pp. 91-94.
Nascimento, V.H., "Improving the Initial Convergence of Adaptive Filters: Variable-Length LMS Algorithms," 2002 IEEE, pp. 667-670.
Pornimitkul, P. et al., 2102797 Statistic Digital Signal Processing, Comparison of NLMS and RLS for Acoustic Echo Cancellation (AEC) and White Gaussian Noise (WGN), Department of Electrical Engineering Faculty of Engineering, Chulalongkorn University, 2002, pp. 1-19.
Puder, H. et al., "Improved Noise Reduction for Hands-Free Car Phones Utilizing Information on a Vehicle and Engine Speeds," Signal Theory, Darmstadt University of Technology, 2000, pp. 1851-1854.
Quatieri, T.F. et al., "Noise Reduction Using a Soft-Decision Sine-Wave Vector Quantizer," International Conference on Acoustics, Speech & Signal Processing, 1990, pp. 821-824.
Quelavoine, R. et al., "Transients Recognition in Underwater Acoustic with Multilayer Neural Networks," Engineering Benefits from Neural Networks, Proceedings of the International Conference EANN 1998, Gibraltar, Jun. 10-12, 1998 pp. 330-333.
Rabiner L.R., et al: "A Comparative Performance Study of Several Pitch Detection Algorithms," *IEEE Trans. On Acoustics, Speech and Signal Processing*, vol. ASSP-24, No. 5, Oct. 1976, pp. 399-418.
Sasaoka N, et al: "A New Noise Reduction System Based on ALE and Noise Reconstruction Filter," *Circuits and Systems*, 2005. ISCAS 2005. IEEE International Symposium on Kobe, Japan May 23-26, 2005, Piscataway, NJ USA, IEEE May 23, 2005, pp. 272-275.
Seely, S., "An Introduction to Engineering Systems," Pergamon Press Inc., 1972, pp. 7-10.
Shust, M.R. et al., "Electronic Removal of Outdoor Microphone Wind Noise," obtained from the Internet on Oct. 5, 2006 at: <http://www.acoustics.org/press/136th/mshust.htm>, 6 pages.
Shust, M.R., Abstract of "Active Removal of Wind Noise From Outdoor Microphones Using Local Velocity Measurements," *J. Acoust. Soc. Am.*, vol. 104, No. 3, Pt 2, 1998, 1 page.
Simon, G., "Detection of Harmonic Burst Signals," International Journal Circuit Theory and Applications, Jul. 1985, vol. 13, No. 3, pp. 195-201.
Tam, K. et al., "Highly Oversampled Subband Adaptive Filters for Noise Cancellation on a Low-resource DSP System," Proc. Of Int. Conf. on Spoken Language Processing (ICSLP), Sep. 2002, pp. 1-4.
Vaseghi, S. et al., "The Effects of Non-Stationary Signal Characteristics on the Performance of Adaptive Audio Restoration System," 1989, IEEE, pp. 377-380.
Vieira, J., "Automatic Estimation of Reverberation Time," Audio Engineering Society, Convention Paper 6107, 116th Convention, May 8-11, 2004, Berlin, Germany, pp. 1-7.
Wahab A. et al., "Intelligent Dashboard With Speech Enhancement," Information, Communications, and Signal Processing, 1997. ICICS, Proceedings of 1997 International Conference on Singapore, Sep. 9-12, 1997, New York, NY, USA, IEEE, pp. 993-997.
Widrow, B. et al., "Adaptive Noise Cancelling: Principles and Applications," 1975, IEEE, vol. 63, No. 13, New York, pp. 1692-1716.
Zakarauskas, P., "Detection and Localization of Nondeterministic Transients in Time series and Application to Ice-Cracking Sound," Digital Signal Processing, 1993, vol. 3, No. 1, pp. 36-45.

* cited by examiner

600

*set*

Description:

Set a qwa parameter.

Call:

```
<set                                  - the id of the call
  id=<tQwaU32>                        - qwa parameter string id
  param=<tQwaChar[]>                  - data payload
  data=< tQwaChar[]> />
```

Response:

```
<rset
  id=<tQwaU32>                        - the id of the response
  callid=<tQwaU32>                    - the id of the corresponding call message
  param=<tQwaChar[]>                  - qwa parameter string id
  error=<tQwaInt> />                  - return error code
```

Figure 6

700

*get*

Description:

Get a qwa parameter.

Call:

```
<get
        id=<tQwaU32>              - the id of the call
        param=<tQwaChar[] />      - qwa parameter string id
```

Response:

```
<rget
        id=<tQwaU32>              - the id of the response
        callid=<tQwaU32>          - the id of the corresponding call message
704     param=<tQwaChar[]>        - qwa parameter string id
        error=<tQwaInt>           - return error code
706     data=<tQwaChar[]> />      - data (if QWA_OK)
```

Figure 7

800

*stream*

Description:

Stream a qwa parameter.

Call:

```
<stream
        id=<tQwaU32>                - the id of the call
804     param=<tQwaChar[]>          - qwa parameter string id
810     frameskip=<tQwaU16 />       - how many frames to skip between sends
```

Response:

```
820 <rstream
        id=<tQwaU32>                - the id of the response
        callid=<tQwaU32>            - the id of the corresponding call message
        param=<tQwaChar[]>          - qwa parameter string id
        error=<tQwaInt>             - return error code
812     data=<tQwaChar[]> />        - data (if QWA_OK)
```

Figure 8

900

*halt*

Description:

Halt the stream of a qwa parameter.

Call:

```
<halt
        id=<tQwaU32>              - the id of the call
        param=<tQwaChar[]> />     - qwa parameter string id
```

Response:

```
<rhalt
        id=<tQwaU32>              - the id of the response
        callid=<tQwaU32>          - the id of the corresponding call message
        error=<tQwaInt>           - return error code
```

Figure 9

1000

*streamaudio*

Description:

Stream a QWA audio channel. The response will always contain binary data.

Call:

```
<streamaudio
        id=<tQwaU32>                - the id of the call
        callid=<tQwaU32>            - the id of the corresponding call message
1004    chantype=<tQwaChar[]>       - type of channel ( mic, ref, out )
        chanid=< tQwaU8>            - channel id
1006    sync=< tQwaU8> />           - optional sync start interpreted as false if 0
        else true. Default is false.
```

Response:

```
<rstreamaudio
        id=<tQwaU32>                - the id of the response
        callid=<tQwaU32>            - the id of the corresponding call message
        chantype=<tQwaChar[]>       - type of channel ( mic, ref, out )
        chanid=< tQwaU8>            - channel id
        error=<tQwaInt>             - return error code
        endian=<tQwaU32>            - endian check for data (0x0A0B0C0D)
        length=<tQwaU32>            - length of data payload (if QWA_OK)
        data=< tQwaU8[]> />         - data (if QWA_OK)
```

Figure 10

1100

*haltaudio*

Description:

Halt the stream of a qwa audio channel.

Call:

```
<haltaudio
    id=<tQwaU32>              - the id of the call
    chantype=<tQwaChar[]>     - type of channel ( mic, ref, out )
    chanid=< tQwaU8> />       - channel id
```

Response:

```
<rhaltaudio
    id=<tQwaU32>              - the id of the response
    callid=<tQwaU32>          - the id of the corresponding call message
    error=<tQwaInt> />        - return error code
```

Figure 11

1200

*injectaudio*

Description:

Stream a QWA audio channel. The response will always contain binary data.

Call:

```
<injectaudio
        id=<tQwaU32>                - the id of the call
        chantype=<tQwaChar[]>       - type of channel ( mic, ref, out )
        chantype=< tQwaU8>          - channel id
        endian=<tQwaU32>            - endian check for data (0x0A0B0C0D)
        length=<tQwaU32>            - length of data payload (if QWA_OK)
1204    data=< tQwaU8[]> />         - data (if QWA_OK)
```

Response:

```
<rinjectaudio
        id=<tQwaU32>                - the id of the response
        callid=<tQwaU32>            - the id of the corresponding call message
        chantype=<tQwaChar[]>       - type of channel ( mic, ref, out )
        chanid=< tQwaU8>            - channel id
        error=<tQwaInt> />          - return error code
```

Figure 12

1300

*startaudio*

Description:

Sync starts all audio channels that have been given the stream command with the sync attribute set to a value greater than 0.

Call:

```
<startaudio
        id=<tQwaU32> />          - the id of the call
```

Response:

```
<rstartaudio
        id=<tQwaU32>             - the id of the response
        callid=<tQwaU32>         - the id of the corresponding call message
        error=<tQwaInt> />       - return error code
```

Figure 13

1400

*reset*

Description:

Signal the client application to reset the QWA

Call:

```
<reset
        id=<tQwaU32> />          - the id of the call
```

Response:

```
<rreset
        id=<tQwaU32>             - the id of the response
        callid=<tQwaU32>         - the id of the corresponding call message
        call=<tQwaChar[]>        - the type of call (in this case call='reset')
        error=<tQwaInt> />       - return error code
```

Figure 14

1500

*restart*

Description:

Signal the client application to destroy then create the QWA

Call:

```
<restart
        id=<tQwaU32> />          - the id of the call
```

Response:

```
<rrestart
        id=<tQwaU32>             - the id of the response
        callid=<tQwaU32>         - the id of the corresponding call message
        error=<tQwaInt> />       - return error code
```

Figure 15

1600

*init*

Description:

Set a qwa parameter which can be initialized during qwaRcsProcessInit().

Call:

```
<init
        id=<tQwaU32>              - the id of the call
1604    param=<tQwaChar[]>        - qwa parameter string id
        data=<tQwaChar[]> />      - data
```

Response:

```
<rinit
        id=<tQwaU32>              - the id of the response
        callid=<tQwaU32>          - the id of the corresponding call message
        param=<tQwaChar[]>        - qwa parameter string id
        error=<tQwaInt> />        - return error code
```

Figure 16

1700

*version*

Description:

Query the QWA_RCS for the protocol version.

Call:

```
<version
        id=<tQwaU32> />              - the id of the call
```

Response:

```
<rversion
        id=<tQwaU32>                 - the id of the response
        callid=<tQwaU32>             - the id of the corresponding call message
        rcs=<tQwaChar[]>             - version of QWA_RCS
        qwa=<tQwaChar[]> />          - version of QWA
```

Figure 17

1800

*Generic Error*

Description:

Used when the calling type can not be distinguished

Call:

N/A

Response:

```
<error
        id=<tQwaU32>            - the id of the response
        callid=<tQwaU32>        - the id of the corresponding call message
        error=<tQwaInt />       - return error code
```

Figure 18

1900

*User defined Response*

Description:

User defined message.

Call:

N/A

Response:

```
<ruser
        id=<tQwaU32>                - the id of the response
        error=<tQwaInt />           - return error code
        data=<tQwaChar[]> />        - user defined character data
```

Figure 19

REMOTE CONTROL SERVER PROTOCOL SYSTEM

PRIORITY CLAIM

This application claims the benefit of priority from U.S. Provisional Application Ser. No. 60/973,131, filed Sep. 17, 2007, which is incorporated by reference.

BACKGROUND OF THE INVENTION

1. Technical Field

This disclosure relates to a communications protocol, and more particularly to a protocol that transports control, configuration, and/or monitoring data used in a speech enhancement system in a vehicle.

2. Related Art

Vehicles may include wireless communication systems. A user may communicate with the wireless communication system through a hard-wired interface or through a wireless interface, which may include a hands-free headset. Such wireless communication systems may include or may be coupled to a noise reduction system. The noise reduction system may include a plurality of noise reduction modules to handle the various acoustic artifacts.

To optimize the noise reduction system, a technician may manually adjust the noise reduction system based on the specific acoustic chamber corresponding to the vehicle or vehicle model. Adjusting the noise reduction system by depressing buttons and indicators on the head-end or noise reduction system may be time consuming and expensive. Once the noise reduction system has been initialized, activating and/or deactivating individual modules may require rebooting of the system, which may be time consuming.

SUMMARY

A remote control server protocol system transports data to a client system. The client system communicates with the server application using a platform-independent communications protocol. The client system sends commands and audio data to the server application. The server application may respond by transmitting audio and other messages to the client system. The messages may be transmitted over a single communications channel.

Other systems, methods, features, and advantages will be, or will become, apparent to one with skill in the art upon examination of the following figures, and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

FIG. 6 is a remote control server (RCS) protocol SET message.

FIG. 7 is an RCS protocol GET message.

FIG. 8 is an RCS protocol STREAM message.

FIG. 9 is an RCS protocol HALT message.

FIG. 10 is an RCS protocol STREAMAUDIO message.

FIG. 11 is an RCS protocol HALTAUDIO message.

FIG. 12 is an RCS protocol INJECTAUDIO message.

FIG. 13 is an RCS protocol STARTAUDIO message.

FIG. 14 is an RCS protocol RESET message.

FIG. 15 is an RCS protocol RESTART message.

FIG. 16 is an RCS protocol INIT message.

FIG. 17 is an RCS protocol VERSION message.

FIG. 18 is an RCS protocol GENERIC ERROR message.

FIG. 19 is an RCS protocol USER DEFINED RESPONSE message.

DETAILED DESCRIPTION OF THE PREFERRED EMBODIMENTS

Figure 1:
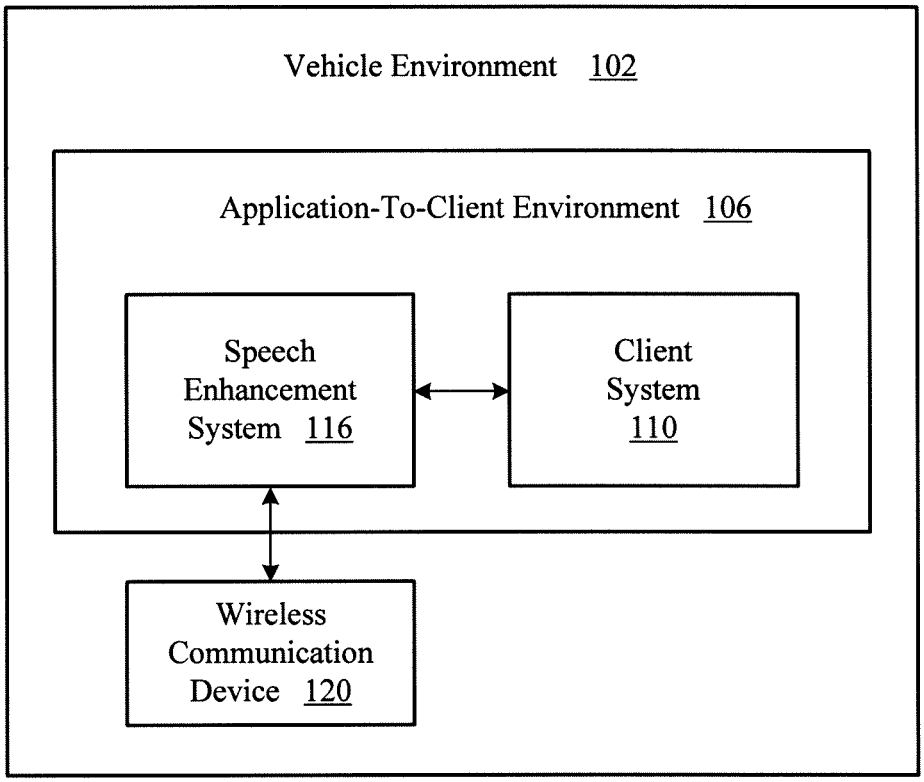
FIG. 1 is a vehicle environment.

The system provides platform and transport independent methods for transferring character and embedded data (e.g., binary data). It allows for the same interface to be used for monitoring multiple channels of audio data and sending and receiving configuration and control parameters. The protocol may handle sending signals to trigger application events in speech signal enhancement systems. FIG. 1 is a vehicle environment 102, which may include an application-to-client environment 106. The application-to-client environment 106 may include a client system 110 and an "application" or speech enhancement system 116. The speech enhancement system 116 may be coupled to or communicate with a wireless communication device 120, such as a wireless telephone system or cellular telephone.

Figure 2:
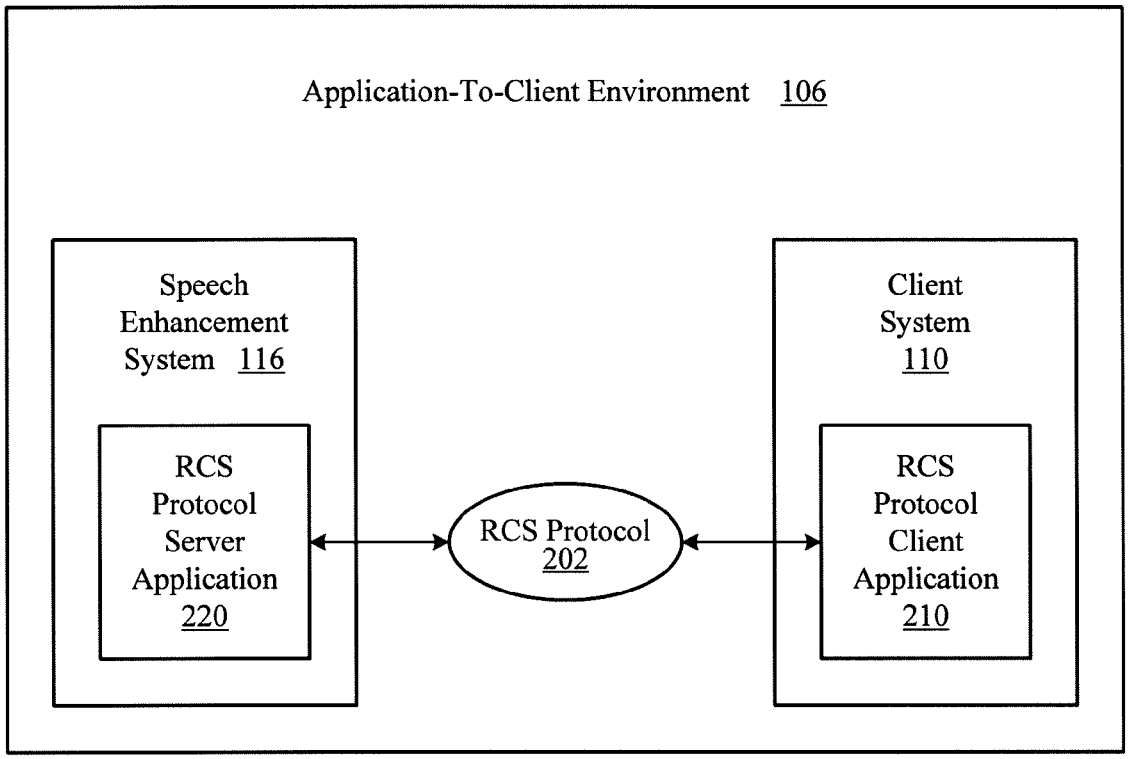
FIG. 2 is an application-to-client environment.

FIG. 2 is the application-to-client environment 106. The speech enhancement system 116 may be an "application" or a "server application." The application or speech enhancement system 116 may be incorporated into the wireless communication device 120 or may be separate from the wireless communication device. The application or speech enhancement system 116 may be part of a head-end device or audio component in the vehicle environment 102.

The client system 110 may be a portable computer, such as laptop computer, terminal, wireless interface, or other device used by a technician or user to adjust, tune, or modify the speech enhancement system 116. The client system 110 may be separate and independent from the speech enhancement system 116, and may run under a Windows® operating system. Other operating systems and/or computing platforms may also be used.

The application-to-client environment 106 may provide a platform and transport independent system for transferring commands, messages, and data, such as character data, embedded data, binary data, audio streams, and other data, between the client system 110 and the speech enhancement system 116 by using a remote control server (RCS) protocol 202. The RCS protocol 202 may be a communications protocol that may transport control data, configuration data and/or for monitoring data between the speech enhancement system 116 and the client system 110. Data may be sent over a single or common interface or channel. The RCS protocol 202 may permit a user to efficiently tune and adjust the speech enhancement system 116 in the vehicle for optimum performance through the client system 110. Because the acoustic "chamber" may differ from vehicle to vehicle and from vehicle model to vehicle model, a user may tune and adjust the parameters of the speech enhancement system 116 for each specific acoustic environment loudly or remotely.

The client system 110 may include an RCS protocol client application 210, which may comprise a software "plug-in." The RCS protocol client application 210 may translate commands issued by the client system 110 under user control into an RCS protocol format 202. The speech enhancement system 116 may include a corresponding RCS protocol server application 220, which may comprise a software "plug-in." The RCS protocol server application 220 may translate data and commands received from the client system 110 in an RCS protocol format 202 into control commands and data, which may be processed by the speech enhancement system 116. By using the software 210 and 220, communication may occur independent of the platform.

Figure 3:
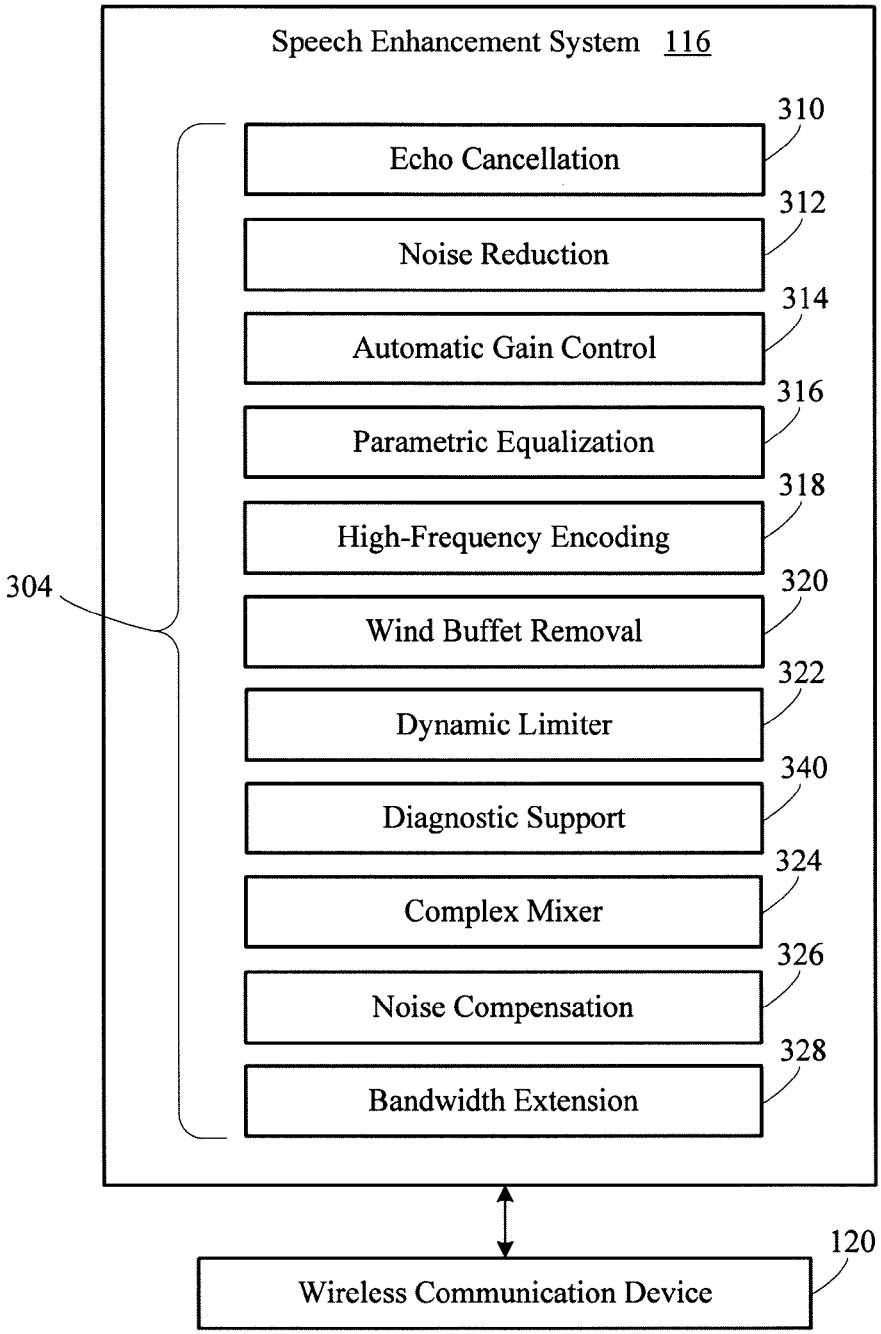
FIG. 3 is a speech enhancement system.

FIG. 3 is the speech enhancement system 116. The speech enhancement system 116 may include a plurality of software and/or hardware modules or processing modules 304. The speech enhancement system 116 may be implemented in software, hardware, or a combination of hardware and software. Each processing module 304 may perform a speech enhancement or noise reduction process to improve the speech quality of the wireless communication device 120 with which it communicates. The speech enhancement system 116 may improve or extract speech signals in the vehicle environment 102, which may be degraded by cabin noise due to road surface conditions, engine noise, wind, rain, external noise, and other noise.

In some systems, the processing modules 304 may comprise a collection of routines and data structures that perform tasks, and may be stored in a library of software programs. The processing module may include an interface that recognizes data types, variables and routines in an implementation accessible only to the module. The processing modules may be accessed to process a stream of audio data received from or sent to the wireless communication device 120. Any of the processing modules 304 may process the audio data during operation of the speech enhancement system 116. The speech enhancement system 116 may process a stream of audio data on a frame-by-frame basis. A frame of audio data may include, for example, 128 samples of audio data. Other frame lengths may be used. Each sample in a frame may represent audio data digitized at a basic sample rate of about 8 KHz or about 16 KHz, for example.

The processing modules 304 may be "created" or generated during initialization of the speech enhancement system 116 or during normal operation of the speech enhancement system that may be under control of the client system 110. During the generation process 304, memory may be mapped, allocated, and configured for some or all of the modules, and various parameters may be set. The processing modules 304 may be uninstalled during initialization or during normal operation of the speech enhancement system 116 under the control of the client system 110.

Each processing module 304 or software process (or hardware) that performs the speech enhancement processing may be accessed and copied from a library of speech enhancement processes into memory. The speech enhancement system 116 may include processing modules, such as an echo-cancellation module 310, a noise reduction module 312, an automatic gain control module 314, a parametric equalization module 316, a high-frequency encoding module 318, a wind buffet removal module 320, a dynamic limiter module 322, a complex mixer module 324, a noise compensation module 326, and a bandwidth extension module 328. For example, a signal enhancement module may be included, which may be described in application Ser. Nos. 10/973,575, 11/757,768, and 11/849,009, which are incorporated by reference. Such processing modules may process data on the receive side or the transmit side. A diagnostic support module 340 may be included to facilitate debugging of the speech enhancement system 116. Other noise reduction or speech enhancement modules 304 may be included. The speech enhancement system 116 may be a compiled and linked library of processing modules available from Harman International of California under the name of Aviage Acoustic Processing System.

Figure 4:
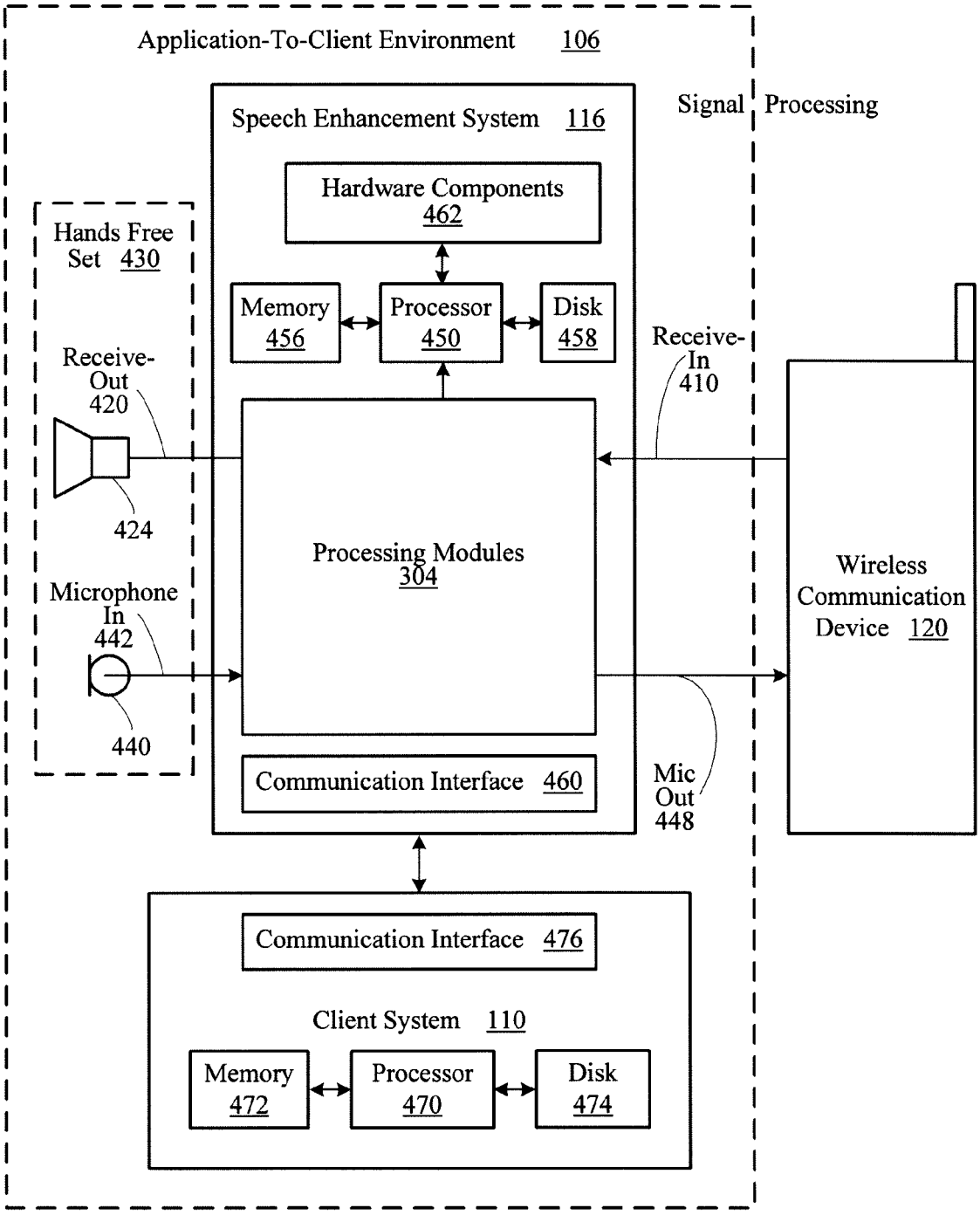
FIG. 4 is an application-to-client environment.

FIG. 4 shows an application-to-client environment 106. The processing modules 304 may receive a "receive-in" audio signal 410 from the wireless communication device 120. The processing modules 304 may process the "receive-in" audio signal 410 to enhance the signal, and may transmit a "receive-out" audio signal 420 to a loudspeaker 424. The loudspeaker 424 may be part of a hands-free set 430, which may be coupled to the wireless communication device 120. A microphone 440 or other transducer may receive user speech and may provide a "microphone-in" signal 442 to the processing modules 304. The processing modules 304 may process the "microphone-in" signal 442 to enhance the signal and may transmit the audio signal ("microphone-out" 448) to the wireless communication device 120.

The speech enhancement system 116 may include a processor 450 or other computing device, memory 456, disk storage 458, a communication interface 460, and other hardware 462 and software components. The processor 450 may communicate with various signal processing components, such as filters, mixers, limiters, attenuators, and tuners, which may be implemented in hardware or software or a combination of hardware and software. Such signal processing components may be part of the speech enhancement system 116 or may be separate from the speech enhancement system. The client system 110 or portable computer may also include a processor 470 or other computing device, memory 472, disk storage 474, a communication interface 476, and other hardware and software components.

Figure 5:
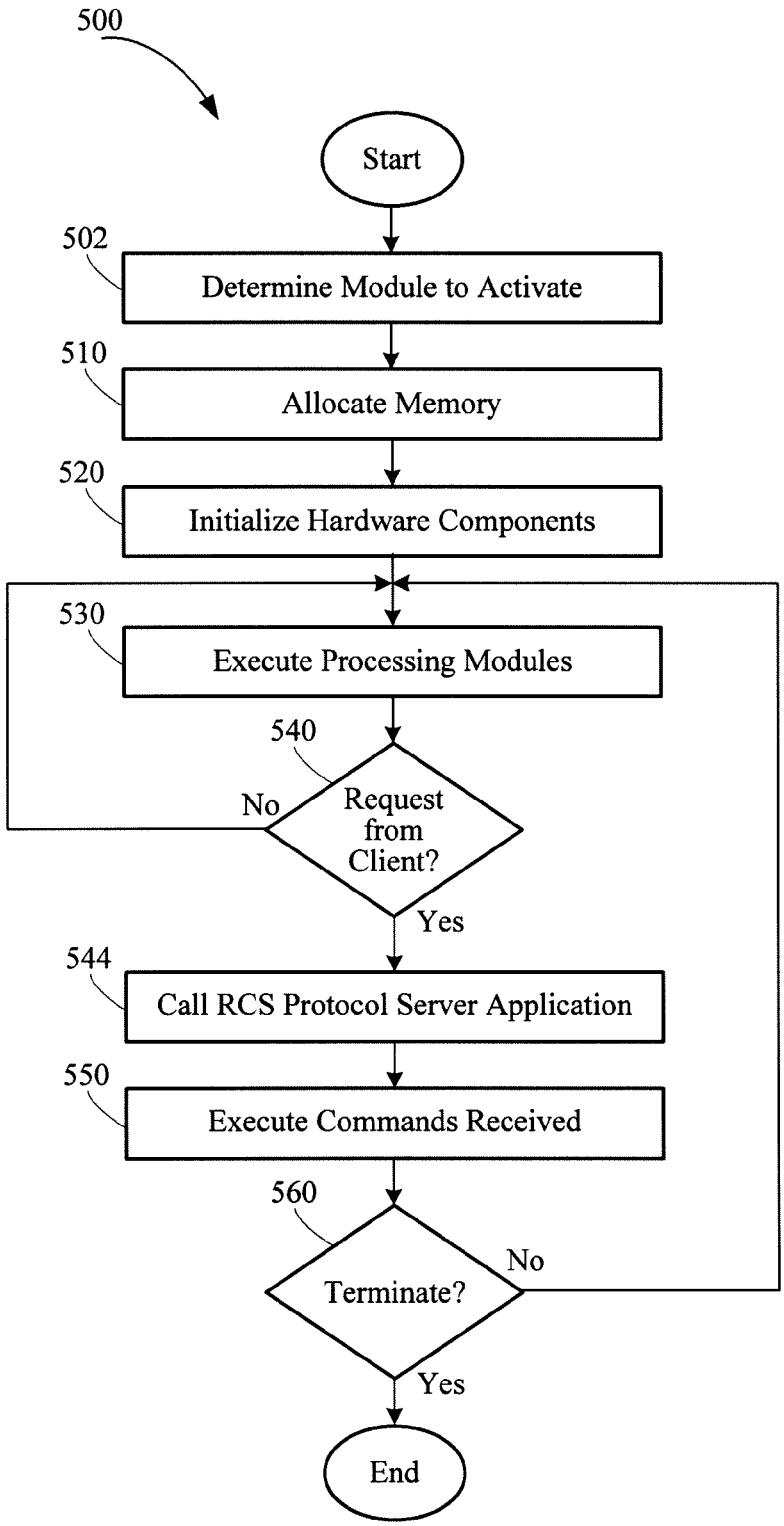
FIG. 5 is a speech enhancement process.

FIG. 5 is a speech enhancement process 500, which may be executed by the speech enhancement system 116. The processor 450 may determine which group of the processing modules to create (Act 502), which may be based on initialization parameters stored in memory or may be based on initialization commands issued by the client system 110 under user control. The processor 450 may perform a "create" process, which may allocate buffer space in the memory for storing parameters and flags corresponding to the processing modules (Act 510). Depending on the processing modules activated, the processor 450 may initialize corresponding hardware components (Act 520).

The processing modules 304 may process the audio data from the wireless communication device 120 serially or in a parallel manner (Act 530). The processor 450 may periodically determine if a request (message and/or command) has been received from the client system 110 (Act 540). In some systems, the client request may request service from the processor 450.

When a request is received from the client system 110, the processor 450 may call the RCS protocol server application 220 to translate an RCS protocol message received from the client system 110 (Act 544). The RCS protocol server application 220 may be an API (application programming interface) program. The API 220 may recognize the commands, instructions, and data provided in RCS protocol format and may translate such information into signals recognized by the speech enhancement system 116. The processor 450 may execute a process (Act 550) specified by the client system 110. If a terminate signal is detected (Act 560), the link between the client system and the application may be terminated. If no terminate signal is received, processing by the processing modules 304 may continue (Act 530).

FIGS. 6-19 are RCS protocol messages or commands. FIG. 6 is an RCS protocol SET message 600. The RCS protocol messages may follow XML formatting rules or rules derived or substantially derived from XML formatting rules. Each message or command may open with a left-hand triangular bracket "<" 602 and may close with a right-hand triangular bracket preceded with a slash "/>" 604. Each message may include the name of the message 610 followed by the appropriate attributes 620 and their values 624. The value of each attribute 620 may be enclosed within matched triangular brackets < . . . > 630. Single quotation marks may also be used to enclose the attribute value depending on the XML software version used. Attributes may be separated by white space. Each message or command may include a sequence identifier 636, shown as "id." The RCS client application 210 may increment the message "id" 636 for each of its calls, while the RCS server application 220 may increment the "id" of each of its responses. This permits matching of a particular call with its response.

A response ("rset" 646) sent by the application 116 in response to the message sent by the client system 110 may include attributes 650 returned by the message call. An "error" parameter 656 may contain a code 658 indicating that an error has occurred or that no error has occurred. A "no error" indication means that the "set" message was received correctly. The types of information described above may apply to each of the messages described in FIGS. 6-19. The format of the values associated with each attribute may be defined as follows:

| |
|---|
| tQuaU32 = unsigned thirty-two bit integer value |
| tQuaU16 = unsigned sixteen bit integer value |
| tQuaU8 = unsigned eight bit integer value |
| tQuaInt = integer value |
| tQuaChar = character |

The SET message 600 may be used to set or define parameters or variables in the processing modules 304. For example, a noise reduction floor, which may be a parameter in the noise reduction module 312, may be set to 10 dB using this message. A character string "noise reduction floor" may be entered into a "param" field 662 to identify the parameter to be set, and the value of 10 may be entered into a "data" field 664.

FIG. 7 is an RCS protocol GET message 700. The GET message 700 may be sent by the client system 110 to obtain the value of a parameter stored in the memory of the speech enhancement system 116. A "param" attribute 704 may identify a name of the parameter to retrieve and a "data" attribute 706 returned may contain the requested value.

FIG. 8 is an RCS protocol STREAM message 800. The STREAM message 800 may perform a similar function as the GET message 700, but rather than returning a single parameter value, the STREAM message may cause the application 116 to return a continuous stream of the requested parameter data on a frame-by-frame basis. Transmission of the stream may continue until terminated by a halt command. For example, if a "param" attribute 804 is set to "clipping status" and a "frameskip" attribute 810 is set to a value of 10, the server application, in this example, the speech enhancement system 116, may return a sequential stream of messages. A "data" value 812 in the returned message 820 may represent whether a frame exhibited audio clipping, and such data may be returned for every $10^{th}$ frame of audio data. This may reduce data transfer bandwidth, depending on the value of the "frameskip" attribute 810. The client system 110 may save the data returned 812 by the STREAM message 800 in a queue or memory for analysis.

FIG. 9 is an RCS protocol HALT message 900. The HALT message 900 may terminate the STREAM message 800 data transmission of FIG. 8. When the application 116 receives the HALT message 900, the transmission of STREAM data 812 may be terminated.

FIG. 10 is an RCS protocol STREAMAUDIO message 1000. The STREAMAUDIO message 1000 may obtain an audio stream from the wireless communication device 120 before it is processed by the application or speech enhancement system 116. For example, the speech enhancement system 116 may receive audio data (speech) on four channels, based on multiple microphones. To analyze the audio stream prior to processing by the speech enhancement system 116, the client system 110 may set a "chantype" attribute (channel type) 1004 to a value of "mic-in." This may indicate that microphone audio data is requested. A "chanid" attribute 1006 may be set to a value of about two, which may indicate that a second microphone channel is desired. Once the application 116 receives the STREAMAUDIO command 1000, it will continue to send the audio data (microphone data) to the client system 110 on a continuous frame-by-frame basis, until terminated by a halt command.

FIG. 11 is an RCS protocol HALTAUDIO message 1100. The HALTAUDIO message 1100 may terminate the STREAMAUDIO message 1000 data transmission shown in FIG. 10. When the application 116 receives the HALTAUDIO message 1100, transmission of STREAMAUDIO data may be terminated.

FIG. 12 is an RCS protocol INJECTAUDIO message 1200. The INJECTAUDIO message 1200 may inject or direct an audio stream, such as a test audio pattern, from the client system 110 to the speech enhancement system 116, by bypassing audio inputs. This message may be used to evaluate and debug various processing modules 304 in the speech enhancement system 116. The client system 110 may send, for example, 512 bytes of data to the speech enhancement system 116 using the INJECTAUDIO command 1200, which may be specified in a "length" attribute 1204. Other payload lengths may be used.

FIG. 13 is an RCS protocol STARTAUDIO message 1300. The STARTAUDIO message 1300 may synchronize audio streams transmitted in response to the STREAMAUDIO message 1000 shown in FIG. 10. Streams of audio data from multiple channels may be synchronized or transmitted from the application 116 to the client system 110 such that each channel transmission may be aligned in frame number. Use of the STARTAUDIO message 1300 assumes that the STREAMAUDIO message 1000 has been previously transmitted. The STARTAUDIO message 1300 acts as the trigger to begin stream transmission.

FIG. 14 is an RCS protocol RESET message 1400. The RESET message 1400 may cause the speech enhancement system 116 to reset parameters of the speech enhancement system 116 or application to factory defined default values. In some applications, the command resets all of the programmable parameters.

FIG. 15 is an RCS protocol RESTART message 1500. The RESTART message 1500 may cause the speech enhancement system 116 to de-allocate the memory corresponding to all of the processing modules 304. After the memory has been de-allocated, the speech enhancement system 116 may allocate the memory corresponding to all of the processing modules 304 to be activated.

FIG. 16 is an RCS protocol INIT message 1600. The INIT message 1600 may define which of the processing modules 304 will be created in response to the RESTART message 1500 shown in FIG. 15. A "param" attribute 1604 may contain the name of the processing module to be created. The speech enhancement system 116 may save the names of the processing modules in a queue or buffer based on the transmission of one or more INIT messages 1600. When the RESTART message 1500 is received, the speech enhancement system 116 may then create or allocate memory for all of the processing modules whose names or identifiers have been saved in the queue or buffer.

FIG. 17 is an RCS protocol VERSION message 1700. The VERSION message 1700 may provide a version identifier of the RCS protocol 202 and the processing modules 304. FIG. 18 is an RCS protocol GENERIC ERROR message 1800. The GENERIC ERROR message 1800 may inform the client system 110 that an unrecognizable message has been received by the application or speech enhancement system 116. FIG. 19 is an RCS protocol USER DEFINED RESPONSE message. The USER DEFINED RESPONSE message 1900 may be used to provide a customized message from the application 116 to the client system 110.

In some systems, the processing modules 304 may be created and/or destroyed individually by the appropriate commands sent by the client system 110. It is not necessary that memory for all of the processes be created or destroyed at one time.

The logic, circuitry, and processing described above may be encoded in a computer-readable medium such as a CDROM, disk, flash memory, RAM or ROM, an electromagnetic signal, or other machine-readable medium as instructions for execution by a processor. Alternatively or additionally, the logic may be implemented as analog or digital logic using hardware, such as one or more integrated circuits (including amplifiers, adders, delays, and filters), or one or more processors executing amplification, adding, delaying, and filtering instructions; or in software in an application programming interface (API) or in a Dynamic Link Library (DLL), functions available in a shared memory or defined as local or remote procedure calls; or as a combination of hardware and software.

The logic may be represented in (e.g., stored on or in) a computer-readable medium, machine-readable medium, propagated-signal medium, and/or signal-bearing medium. The media may comprise any device that contains, stores, communicates, propagates, or transports executable instructions for use by or in connection with an instruction executable system, apparatus, or device. The machine-readable medium may selectively be, but is not limited to, an electronic, magnetic, optical, electromagnetic, or infrared signal or a semiconductor system, apparatus, device, or propagation medium. A non-exhaustive list of examples of a machine-readable medium includes: a magnetic or optical disk, a volatile memory such as a Random Access Memory "RAM," a Read-Only Memory "ROM," an Erasable Programmable Read-Only Memory (i.e., EPROM) or Flash memory, or an optical fiber. A machine-readable medium may also include a tangible medium upon which executable instructions are printed, as the logic may be electronically stored as an image or in another format (e.g., through an optical scan), then compiled, and/or interpreted or otherwise processed. The processed medium may then be stored in a computer and/or machine memory.

The systems may include additional or different logic and may be implemented in many different ways. A controller may be implemented as a microprocessor, microcontroller, application specific integrated circuit (ASIC), discrete logic, or a combination of other types of circuits or logic. Similarly, memories may be DRAM, SRAM, Flash, or other types of memory. Parameters (e.g., conditions and thresholds) and other data structures may be separately stored and managed, may be incorporated into a single memory or database, or may be logically and physically organized in many different ways. Programs and instruction sets may be parts of a single program, separate programs, or distributed across several memories and processors. The systems may be included in a wide variety of electronic devices, including a cellular phone, a headset, a hands-free set, a speakerphone, communication interface, or an infotainment system.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A remote control server protocol system for transporting data, comprising:

a client system having a processor and a memory;

a speech enhancement system in communication with the client system, where the client system communicates with the speech enhancement system remotely using a platform-independent communications protocol configured to control operation of the speech enhancement system;

the client system configured to send command messages to the speech enhancement system, and the speech enhancement system configured to send response messages to the client system in response to the command messages sent from the client system;

where the speech enhancement system comprises a plurality of modules, each of the modules is configured to perform a corresponding speech enhancement process, the client system is configured to tune the speech enhancement system for an acoustic environment with an adjustment of at least one parameter of the speech enhancement system in response to at least one of the command messages sent from the client system with the platform-independent communications protocol, and the speech enhancement system is configured to determine a set of the modules to create based on an initialization parameter sent from the client system with the platform-independent communications protocol, and create each module of the set of modules; and where the command messages and the response messages are sent over a single communications channel using the platform-independent communications protocol.

2. The system of claim 1, where at least one module is a noise reduction module.

3. The system of claim 1, where the speech enhancement processes are selected from a group comprising at least one of an echo-cancellation process, an automatic gain control process, a noise reduction process, a parametric equalization process, a high-frequency encoding process, a wind buffet removal process, a dynamic limiting process, a complex mixing process, a noise compensation process, or a bandwidth extension process.

4. The system of claim 1, where the communications protocol is in an XML or an XML-derived language format.

5. The system of claim 1, where at least one of the modules is destroyed and corresponding memory space is de-allocated remotely under control of the client system using the platform-independent communications protocol.

6. The system of claim 1, where audio stream data messages are sent over the single communications channel using the platform-independent communications protocol.

7. The system of claim 1, further comprising a wireless communication device coupled to the speech enhancement system, where the speech enhancement system is configured to adjust a speech quality of the wireless communication device.

8. The system of claim 1, where the speech enhancement system is configured to create each module of the set of modules by allocating corresponding memory space remotely under control of the client system based on the initialization parameter sent from the client system with the platform-independent communications protocol.

9. A method for transporting data, comprising:

providing a client system;

providing a speech enhancement system in communication with the client system, the speech enhancement system comprising a plurality of modules, each of the modules configured to perform a corresponding speech enhancement process;

sending command messages from the client system to the speech enhancement system over a single communications channel using a platform-independent communications protocol to remotely control operation of the speech enhancement system;

sending response messages from the speech enhancement system to the client system over the single communications channel using the platform-independent communications protocol in response to the command messages sent from the client system;

tuning the speech enhancement system for an acoustic environment with the client system by adjusting at least one parameter of the speech enhancement system in response to at least one of the command messages sent from the client system with the platform-independent communications protocol;

sending an initialization parameter from the client system to the speech enhancement system with the platform-independent communications protocol;

determining a set of the modules to create based on the initialization parameter sent from the client system with the platform-independent communications protocol; and creating each module of the set of modules.

10. The method of claim 9, where at least one module performs a noise reduction process.

11. The method of claim 9, where the speech enhancement processes comprise at least one of an echo-cancellation process, an automatic gain control process, a noise reduction process, a parametric equalization process, a high-frequency encoding process, a wind buffet removal process, a dynamic limiting process, a complex mixing process, a noise compensation process, and a bandwidth extension process.

12. The method of claim 9, where the communications protocol is in an XML or an XML-derived language format.

13. The method of claim 9, where creating each module comprises allocating corresponding memory under control of the client system remotely using the platform-independent communications protocol.

14. The method of claim 9, further comprising:

sending command messages and audio stream data messages from the client system to the speech enhancement system;

sending response messages and audio stream data messages from the speech enhancement system to the client system in response to the command messages sent from the client system; and where the command messages, the audio stream data messages, and the response messages are sent over the single communications channel using the platform-independent communications protocol.

15. A non-transitory computer-readable storage medium comprising instructions executable with a processor to transport data by performing the acts of:

providing a client system operable by a user;

providing a speech enhancement system in communication with the client system, the speech enhancement system comprising a plurality of modules, each of the modules configured to perform a corresponding speech enhancement process;

sending command messages from the client system to the speech enhancement system over a single communications channel using a platform-independent communications protocol to remotely control operation of the speech enhancement system;

sending response messages from the speech enhancement system to the client system over the single communications channel using the platform-independent communications protocol in response to the command messages sent from the client system;

tuning the speech enhancement system for an acoustic environment with the client system by adjusting at least one parameter of the speech enhancement system in response to at least one of the command messages;

sending an initialization parameter from the client system to the speech enhancement system with the platform-independent communications protocol;

determining a set of the modules to create based on the initialization parameter sent from the client system with the platform-independent communications protocol; and creating each module of the set of modules.

16. The computer-readable storage medium of claim 15, further comprising processor executable instructions to cause the processor to perform the act of performing a noise reduction process.

17. The computer-readable storage medium of claim 15, further comprising processor executable instructions to cause the processor to perform the act of selecting at least one speech enhancement process from at least one of an echo-cancellation process, an automatic gain control process, a noise reduction process, a parametric equalization process, a high-frequency encoding process, a wind buffet removal process, a dynamic limiting process, a complex mixing process, a noise compensation process, or a bandwidth extension process.

18. The computer-readable storage medium of claim 15, further comprising processor executable instructions to cause the processor to perform the act of providing the platform-independent communications protocol in an XML or an XML-derived language format.

19. The computer-readable storage medium of claim 15, further comprising processor executable instructions to cause the processor to perform the act of creating each module by allocating corresponding memory under control of the client system remotely using the platform-independent communications protocol.

20. The computer-readable storage medium of claim 15, further comprising processor executable instructions to cause the processor to perform the act of destroying at least one of the plurality of modules by de-allocating corresponding memory space under control of the client system remotely using the platform-independent communications protocol.

21. The computer-readable storage medium of claim 15, further comprising processor executable instructions to:

send command messages and audio stream data messages from the client system to the speech enhancement system;

send response messages and audio stream data messages from the speech enhancement system to the client system in response to the command messages sent from the client system; and where the command messages, the audio stream data messages, and the response messages are sent over the single communications channel using the platform-independent communications protocol.

22. A method for transporting data, comprising:

providing a speech enhancement system comprising a plurality of modules, each of the modules configured to perform a corresponding speech enhancement process;

the speech enhancement system receiving command messages, the command messages sent over a single communications channel using a platform-independent communications protocol and configured to control operation of the speech enhancement system;

sending response messages from the speech enhancement system over the single communications channel using the platform-independent communications protocol in response to the command messages received;

tuning the speech enhancement system for an acoustic environment by adjusting at least one parameter of the speech enhancement system in response to at least one of the command messages;

the speech enhancement system receiving an initialization parameter, the initialization parameter sent over the single communications channel using the platform-independent communications protocol;

determining a set of the modules to create based on the initialization parameter; and creating each module of the set of modules.

23. A method for transporting data, comprising:

providing a client system;

sending command messages from the client system over a single communications channel using a platform-independent communications protocol to remotely control operation of an external application comprising a speech enhancement system;

the client system receiving response messages sent over the single communications channel using the platform-independent communications protocol in response to the command messages sent from the client system;

tuning the speech enhancement system for an acoustic environment with the client system by causing an adjustment of at least one parameter of the speech enhancement system in response to at least one of the command messages sent from the client system;

sending an initialization parameter from the client system over the single communications channel using the platform-independent communications protocol;

causing determination of a set of the modules to be created based on the initialization parameter; and causing each module of the set of modules to be created.

* * * * *